US006655399B1

(12) United States Patent
Williams

(10) Patent No.: US 6,655,399 B1
(45) Date of Patent: Dec. 2, 2003

(54) PORTABLE, ABSORBABLE UMBRELLA STAND

(76) Inventor: Andrea Samuels Williams, 5307 Galway Dr., Charlotte, NC (US) 28215

( * ) Notice: Subject to any disclaimer, the term of this patent is extended or adjusted under 35 U.S.C. 154(b) by 0 days.

(21) Appl. No.: 10/178,847

(22) Filed: Jun. 25, 2002

(51) Int. Cl.[7] ..... A45B 25/24
(52) U.S. Cl. ..... 135/34.2
(58) Field of Search ..... 135/15.1, 18, 34.2, 135/48; 312/206; 211/60.1, 62

(56) References Cited

U.S. PATENT DOCUMENTS 1,031,361 A * 7/1912 Mitchell ..... 135/34.2
1,694,060 A * 12/1928 Duncan ..... 135/18
2,789,571 A * 4/1957 Kurman ..... 135/34.2
3,526,238 A * 9/1970 Brayton ..... 135/34.2
5,323,802 A * 6/1994 Kiedrowski ..... 135/34.2
5,495,866 A * 3/1996 Lu ..... 135/48
5,625,960 A * 5/1997 Fujita ..... 135/34.2 X
6,015,077 A * 1/2000 Disher ..... 135/34.2 X

FOREIGN PATENT DOCUMENTS

IT 486617 * 11/1953 ..... 135/18

* cited by examiner

*Primary Examiner*—James O. Hansen

(57) ABSTRACT

A portable, absorbable umbrella stand including a hard casing for supporting an umbrella, a nylon case containing a drawstring, the case being attached to the casing for enclosing the umbrella, a sponge for collecting water, and fold-up legs attached to the casing for supporting the umbrella stand.

1 Claim, 2 Drawing Sheets

PORTABLE, ABSORBABLE UMBRELLA STAND

"The Portable, Absorbable Umbrella Stand" makes handling and storing a wet umbrella quick, convenient, and neat.

"The Portable, Absorbable Umbrella Stand" will have a nylon case, with a drawstring through the top of it, covering a cylinder-like sponge. This sponge will absorb the water of a wet umbrella. When one arrives at their destination, they can simply pull the sponge out of the case, wring it out, and place it back in the case. The nylon case will be attached to a hard plastic or rubber casing in order for it to be able to stand alone. At the bottom of the hard casing are fold-up legs to allow it to stand upright.

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

FIELD OF INVENTION

"The Portable, Absorbable Umbrella Stand" makes dealing with inclement weather easy and neat. Any age group, from children to senior citizens, can use the invention globally. It provides quick, convenient and neat storage for a wet umbrella, whether at the office, school, church, restaurant, on public transportation, in a car or anywhere.

SUMMARY

"The Portable, Absorbable Umbrella Stand " will solve the problem of storage of a wet umbrella. Instead of having to open it up to dry, one can just slip the wet umbrella into the cylinder with the sponge to absorb the water, then wring it out at a later time.

A clear advantage for this invention is it provides one with an easy way to store a wet umbrella without having to take up much space, and without any hassle.

DETAILED DESCRIPTION OF THE PREFERRED EMBODIMENT

The portable, absorbable umbrella stand, in accordance to the present invention, will be described now with references to FIGS. 1 and 2.

Figure 1:
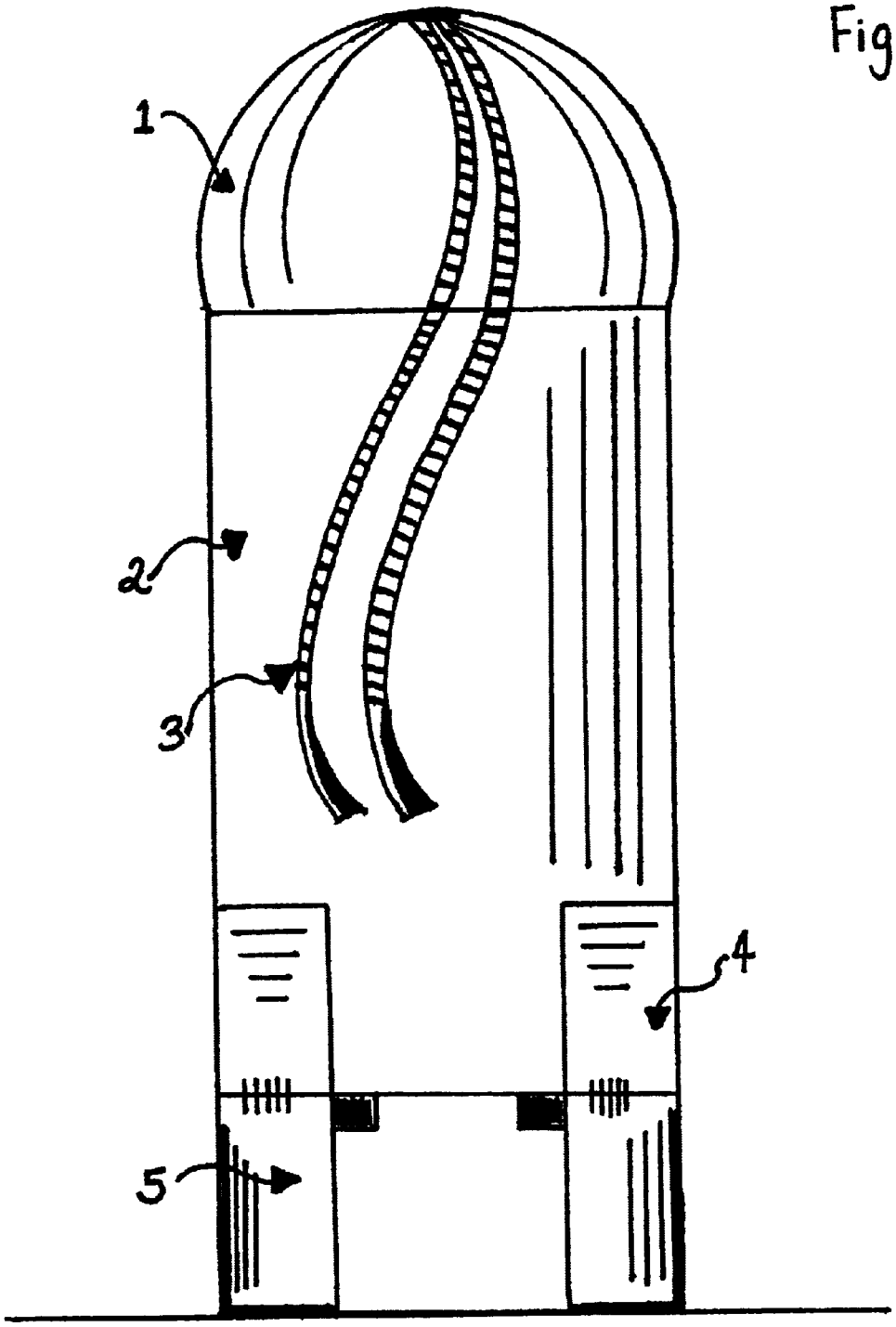
FIG. 1 allows the front view of the invention, "The Portable, Absorbable Umbrella Stand." The nylon case will enclose the umbrella while in storage. The drawstring will help prevent some excess water from leaking out of the case. The hard casing will stabilize the invention so it can stand on its own. The fold-up legs make it easy to store the stand, with the umbrella inside, once at a final destination, if one desires. For placement in a tote bag or a briefcase, the legs can remain folded up in the grooves.
Figure 2:
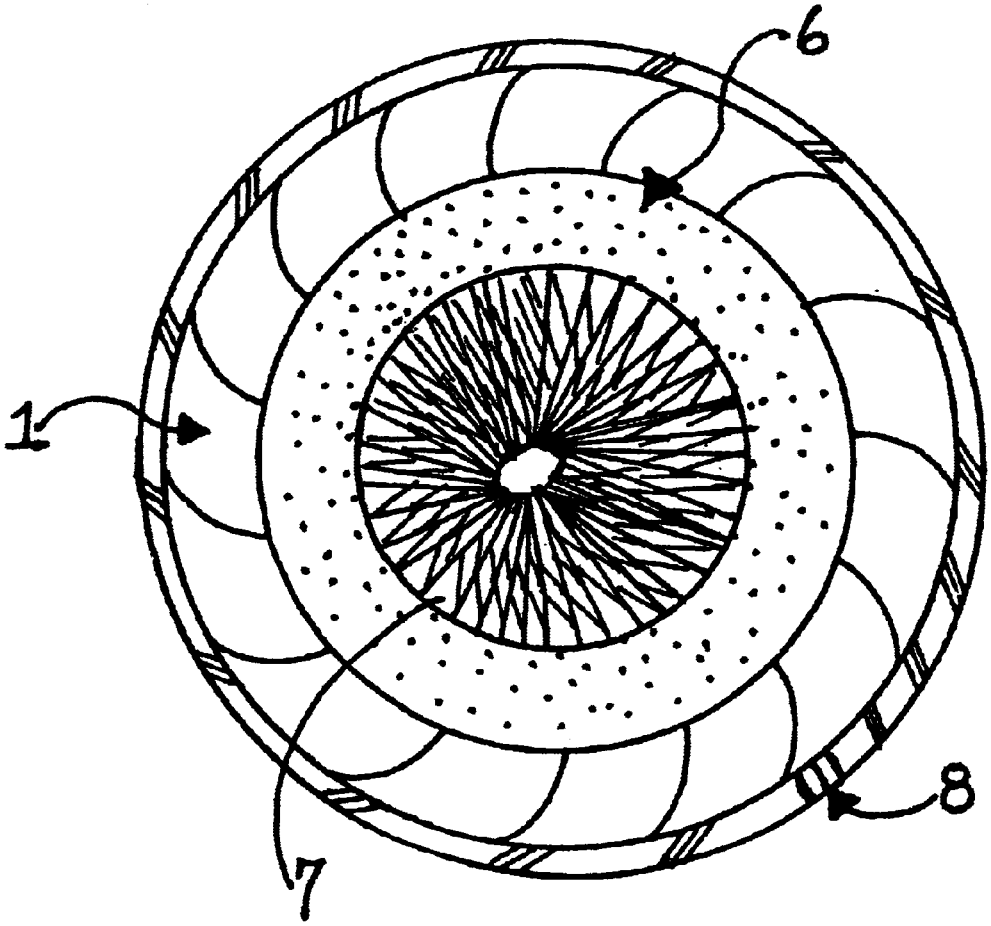
FIG. 2 shows the view from the top of "The Portable, Absorbable Umbrella Stand." The pull-out sponge will absorb the water of the umbrella, once placed in the umbrella cavity. When closed, the nylon case with drawstring, will help to catch any excess water from leaking.

Referring to FIGS. 1 and 2, the portable, absorbable umbrella stand is fundamentally made up of a nylon case 1, a hard casing 2, a drawstring 3, grooves for fold-up legs 4, fold-up legs 5, and a pull-out sponge 6. The nylon case 1, encloses an umbrella placed inside of the hard casing 2, to neatly prevent excess water drained from an umbrella from leaking. Once an umbrella is secured in the umbrella cavity 7, which is located inside of the hard casing 2, the pull-out sponge 6, will absorb water from a wet umbrella. The drawstring 3, will be pulled to keep the umbrella in place and can be used to carry the present invention.

Referring to FIG. 1, the hard casing 2, and nylon case 1, can remain a solid color or subtle pattern, or they can be used as palettes for creativity, depending on a potential manufacturer's vision for the present invention. Thus, popular cartoon characters could be depicted on the hard casing 2, and nylon case 1, to make it fun for children to use. Or, high-fashion designers could choose to display their respective logos on the hard casing 2, and nylon case 1, appealing to the fashion-forward consumer.

Referring to FIG. 2, the drawstring loops 8, is where the drawstrings 3, meet to pull and secure the nylon case 1, to enclose an umbrella and keep excess water from leaking.

Referring to FIGS. 1 and 2, the pull-out sponge 6, when it has absorbed the water from an umbrella, is pulled out and wrung free of the water absorbed. Then, the pullout sponge 6, is placed back inside of the hard casing 2.

Referring to FIG. 1, when the present invention is being stored in an upright position, the fold-up legs 5, are unlocked to stabilize the present invention for neat storage. Or, if one is in transit whether on foot, automobile, bicycle, mass transit or any other means of transportation, the fold-up legs 5, snap into the grooves for the fold-up legs 4, and the present invention can then be transported and/or stored conveniently in a purse, tote bag, briefcase, backpack, neatly placed on the floor of an automobile, or simply carried in one's hand. The present invention would protect one's clothes, personal items and even one's feet from a dripping, cumbersome, wet umbrella May it be apparent that what has been described here in the preferred embodiment of the present invention, is to give examples of its potential use, and does not limit it in any way, from modifications that those skilled in the art may deem necessary to apply. This can be done without deviating from the spirit and scope of the invention as disclosed by the claim.

I claim:

1. A portable, absorbable umbrella stand to enclose and store a wet umbrella, comprising:

a hard casing to support and enable a stored umbrella to stand in an upright position;

a nylon case attached to said hard casing to receive and enclose an umbrella;

a pull-out sponge that rests inside said hard casing to absorb and retain water from an umbrella, then be removed from said hard casing to be wrung free of water;

a drawstring attached to said nylon case and adapted to secure an umbrella while water is being absorbed by said pull-out sponge;

a fold-up leg, attached to said hard casing, to enable said umbrella stand to remain in an upright position;

a groove located in said hard casing for allowing fold-up leg to snap into place when said fold-up leg is not in an upright position to support said umbrella stand.

* * * * *